US007368728B2

(12) United States Patent
Cristoni et al.

(10) Patent No.: US 7,368,728 B2
(45) Date of Patent: May 6, 2008

(54) IONIZATION SOURCE FOR MASS SPECTROMETRY ANALYSIS

(75) Inventors: Simone Cristoni, Zola Predosa (IT); Luigi P. Rossi Bernardi, Milan (IT); Pasquale De Blasio, Milan (IT)

(73) Assignee: Universita' Degli Studi Di Milano, Milan (IT)

( * ) Notice: Subject to any disclaimer, the term of this patent is extended or adjusted under 35 U.S.C. 154(b) by 214 days.

(21) Appl. No.: 10/529,256

(22) PCT Filed: Sep. 30, 2003

(86) PCT No.: PCT/IB03/04297

§ 371 (c)(1),
(2), (4) Date: Oct. 28, 2005

(87) PCT Pub. No.: WO2004/034011

PCT Pub. Date: Apr. 22, 2004

(65) Prior Publication Data

US 2006/0145089 A1 Jul. 6, 2006

Related U.S. Application Data

(60) Provisional application No. 60/417,183, filed on Oct. 10, 2002.

(51) Int. Cl.

| | |
|---|---|
| ***H01J 49/36*** | (2006.01) |
| ***H01J 49/28*** | (2006.01) |
| ***H01J 49/26*** | (2006.01) |
| ***H01J 49/10*** | (2006.01) |

(52) U.S. Cl. ..... 250/425; 250/288; 250/281; 250/282; 250/423 R; 250/424

(58) Field of Classification Search ..... 250/288, 250/425

See application file for complete search history.

(56) References Cited

U.S. PATENT DOCUMENTS 3,479,545 A 11/1969 Wilson et al.
3,770,954 A 11/1973 Davis (Continued)

FOREIGN PATENT DOCUMENTS

DE 1171641 B 6/1964

(Continued)

*Primary Examiner*—Jack I. Berman
*Assistant Examiner*—Bernard Souw
(74) *Attorney, Agent, or Firm*—Browdy and Neimark

(57) ABSTRACT

A new ionization source named Surface Activated Chemical Ionization (SACI) has been discovered and used to improve the sensitivity of the mass spectrometer. According to this invention the ionization chamber of a mass spectrometer is heated and contains a physical new surface to improve the ionization process. The analyte neutral molecules that are present in gas phase are ionized on this surface. The surface can be made of various materials and may also chemically modified so to bind different molecules. This new ionization source is able to generate ions with high molecular weight and low charge, an essential new key feature of the invention so to improve sensitivity and reduce noise. The new device can be especially used for the analysis of proteins, peptides and other macromolecules. The new invention overcomes some of the well known and critical limitations of the Electrospray (ESI) and Matrix Assisted Laser Desorption Ionization (MALDI) mass spectrometric techniques.

30 Claims, 8 Drawing Sheets

U.S. PATENT DOCUMENTS

| | | | | | |
|---|---|---|---|---|---|
| 4,842,701 | A * | 6/1989 | Smith et al. | 204/451 |
| 4,861,988 | A * | 8/1989 | Henion et al. | 250/288 |
| 4,885,076 | A * | 12/1989 | Smith et al. | 204/451 |
| RE34,757 | E * | 10/1994 | Smith et al. | 204/452 |
| 5,352,892 | A * | 10/1994 | Mordehai et al. | 250/288 |
| 5,736,741 | A * | 4/1998 | Bertsch et al. | 250/288 |
| 5,855,851 | A * | 1/1999 | Matsubara et al. | 422/100 |
| 5,858,477 | A * | 1/1999 | Veerasamy et al. | 427/562 |
| 5,869,832 | A * | 2/1999 | Wang et al. | 250/288 |
| 6,107,626 | A * | 8/2000 | Wang et al. | 250/288 |
| 6,437,327 | B2 * | 8/2002 | Takada et al. | 250/288 |
| 6,483,108 | B1 * | 11/2002 | Sakairi | 250/288 |
| 6,649,910 | B2 * | 11/2003 | Sakairi | 250/288 |
| 6,671,161 | B2 * | 12/2003 | Nilsson | 361/212 |
| 6,784,421 | B2 * | 8/2004 | Park | 250/281 |
| 6,794,646 | B2 * | 9/2004 | Tong et al. | 250/288 |
| 6,812,453 | B2 * | 11/2004 | Bateman et al. | 250/287 |
| 6,891,153 | B2 * | 5/2005 | Bateman et al. | 250/281 |
| 6,906,322 | B2 * | 6/2005 | Berggren et al. | 250/288 |
| 7,021,122 | B1 * | 4/2006 | Rosemberg et al. | 73/54.01 |
| 7,196,323 | B2 * | 3/2007 | Walk et al. | 250/282 |
| 7,232,992 | B2 * | 6/2007 | Whitehouse et al. | 250/288 |
| 2006/0016982 | A1 * | 1/2006 | Russ et al. | 250/288 |
| 2006/0145089 | A1 * | 7/2006 | Cristoni et al. | 250/423 F |
| 2006/0219891 | A1 * | 10/2006 | Balogh | 250/288 |
| 2006/0237663 | A1 * | 10/2006 | Balogh | 250/424 |
| 2006/0284106 | A1 * | 12/2006 | Russ et al. | 250/426 |
| 2007/0164209 | A1 * | 7/2007 | Balogh | 250/288 |

FOREIGN PATENT DOCUMENTS

| | | |
|---|---|---|
| EP | 0153113 A2 | 8/1985 |

* cited by examiner

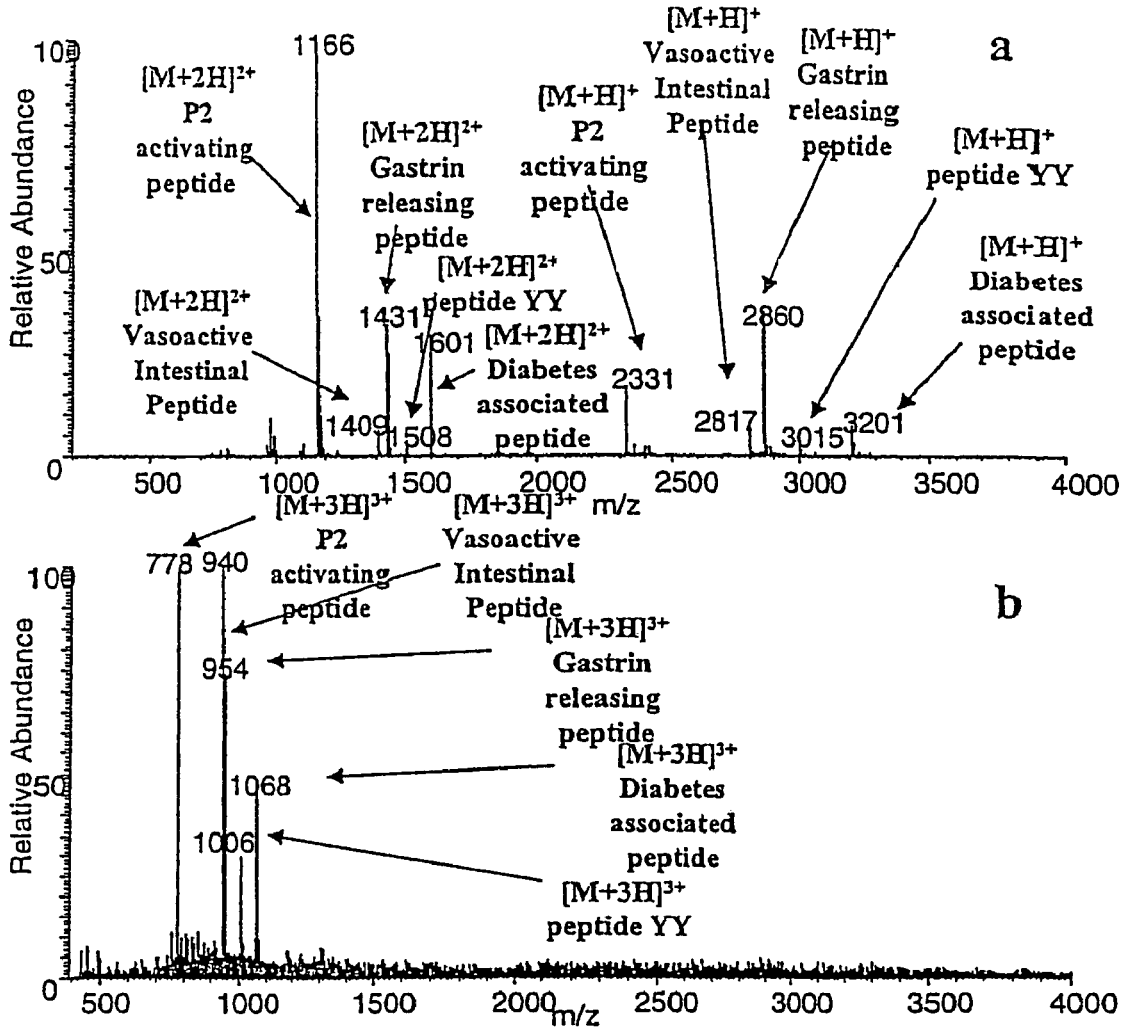

Figure 2: a) Mass spectrum, obtained by direct infusion in the mass spectrometer using the GPSCI technique, of a sample containing a mixture of five peptides (peptide YY fragments 13-36 obtained from Sigma catalog number P6613 MW: 3014 Da; Diabetes associated peptide amine rat fragment 8-37 obtained from Sigma catalog number. D6170 MW:.3200 Da; Gastrin releasing peptide human obtained from Sigma catalog number G8022 MW: 2859 Da; Phospholipase 2 activating peptide obtained from Sigma catalog number. G1153 MW: 2330 Da and Vasoactive Intestinal Peptide Fragment 6-28 obtained from Sigma catalog number V4508 MW: 2816 Da) acquired in the 400 – 4000 Th range. The solution concentration of each peptide was 10-7 M. The counts/s value was 106 and the S/N ratio of the most abundant peak was 500. No salts were added in the pure H2O solution containing the peptides. b) Mass spectrum, obtained by direct infusion in the mass spectrometer using the ESI technique, of the same solution as in (a),. The counts/s value was 105 and the S/N ratio of the most abundant peak was 100

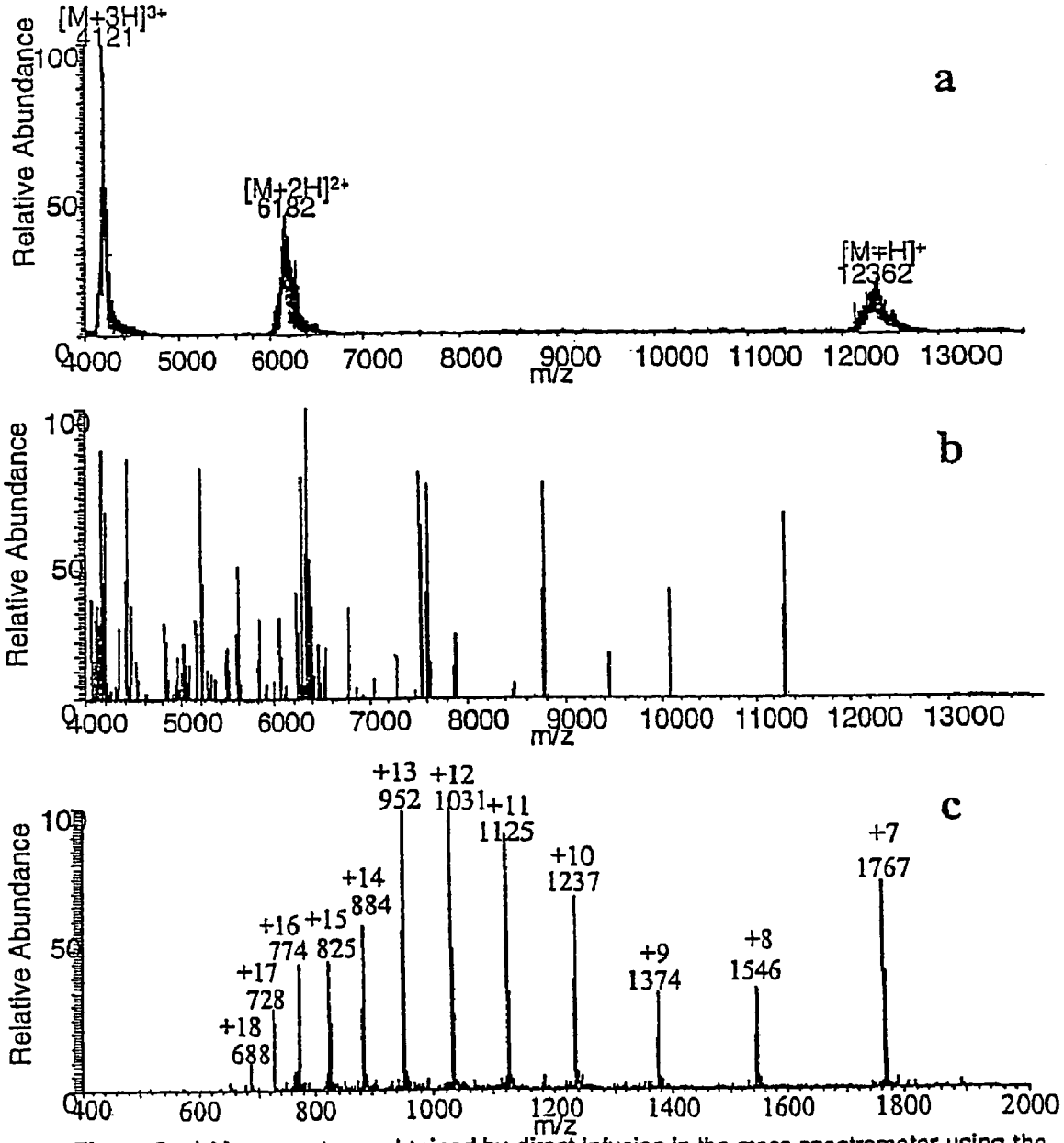

Figure 3: a) Mass spectrum, obtained by direct infusion in the mass spectrometer using the GPSCI technique, of a standard protein (Cytochrome C) acquired in the 4000 – 14000 Th range. The protein was obtained by Sigma-Aldrich (catalog number 10,520-1) and diluted in H2O so to obtain a concentration of 10-7 M. The counts/s value was 106 and the S/N ratio of the most abundant peak was 300. b) Mass spectrum obtained by direct infusion in the mass spectrometer using the ESI technique, of the same solution as in (a). c) Multicharge distribution of the Cytochrome C protein obtained using the ESI ionization source.

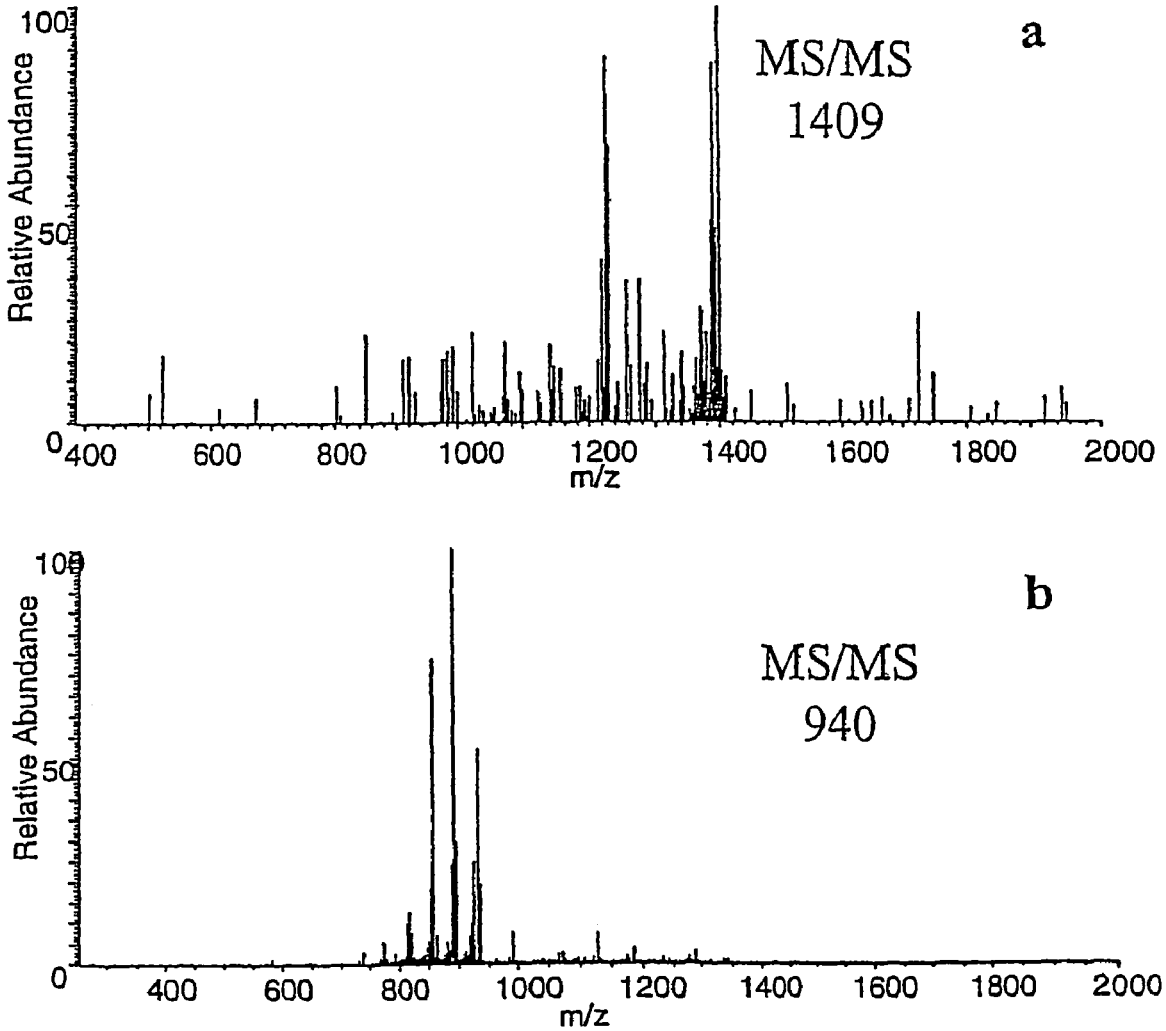
Figure 4: a) Tandem mass spectrum, obtained by using the GPSCI technique, of the bi-charge ion of Vasoactive Intestinal Peptide Fragment 6-28 at m/z 1409. b) Tandem mass spectrum of the same solution, obtained using the ESI techniques. The tri-charge ion at m/z 940 was fragmented.

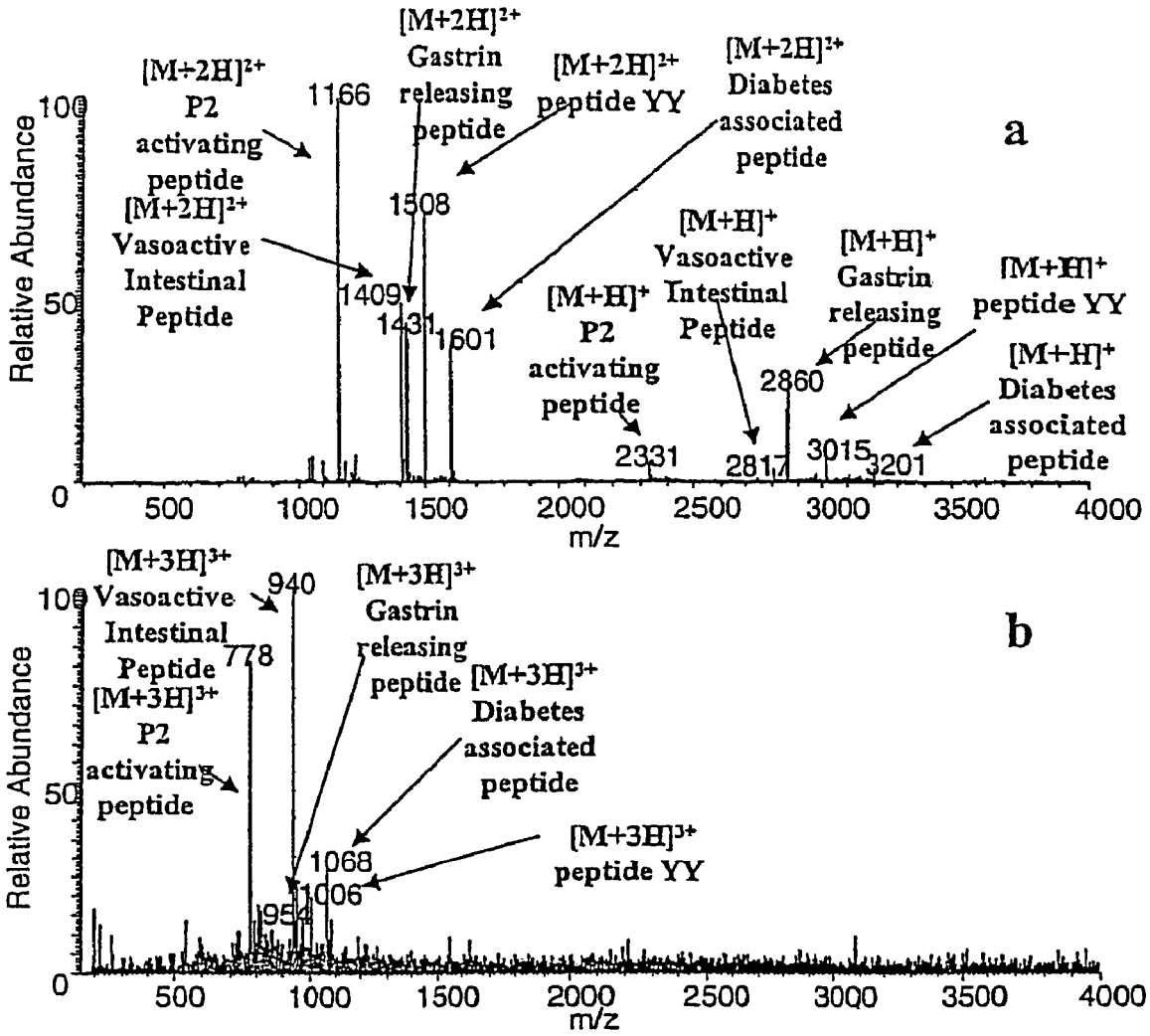

Figure 5: a) Mass spectrum, obtained by direct infusion in the mass spectrometer using the GPSCI technique, of a sample containing a mixture of five peptides, as in figure 2a, acquired in the 400 – 4000 Th range. The solution had a ammonium bicarbonate (NH4HCO3) concentration of 50 mmol/L. The counts/s value was 106 and the S/N ratio of the most abundant peak was 500. b) Mass spectrum obtained by direct infusion in the mass spectrometer using the ESI technique, of the same solution as in (a). The counts/s value was 105 and the S/N ratio of the most abundant peak was 100.

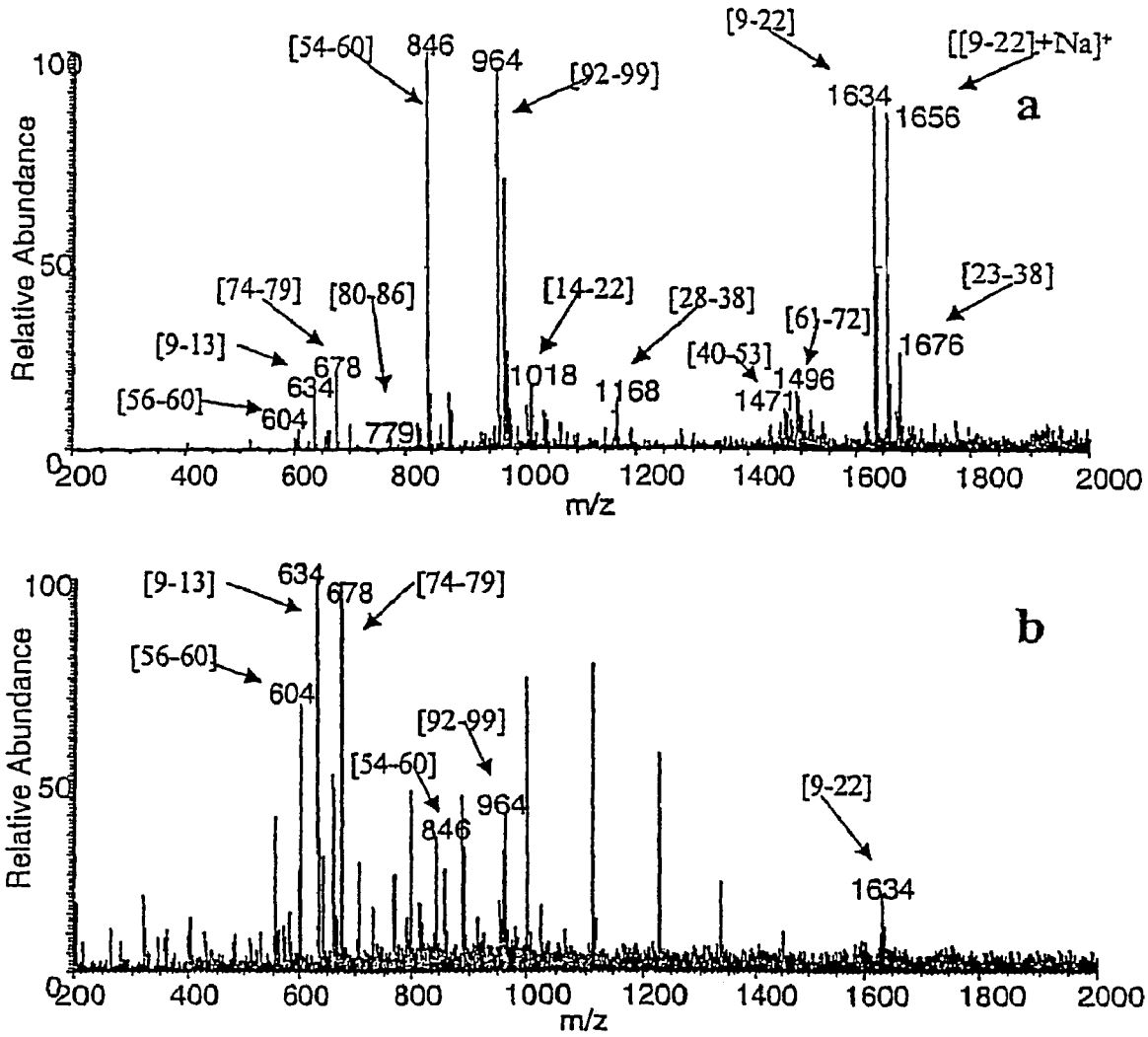

Figure 6: a) Mass spectrum, obtained by direct infusion in the mass spectrometer using the GPSCI technique, of a peptide mixture obtained by tryptic enzymatic digestion of Cytochrome C, in the presence of 50 mmol/L NH4HCO3. The identified peptides are marked by their amino acidic intervals as compared with the original protein sequence. The initial (before tryptic digestion) concentration of the protein was 10-7 M. The counts/s value was 106 and the S/N ratio of the most abundant peak was 450. b) Mass spectrum, obtained by direct infusion in the mass spectrometer using the ESI technique, of the same solution. The counts/s value was 105 and the S/N ratio of the most abundant peak was 100.

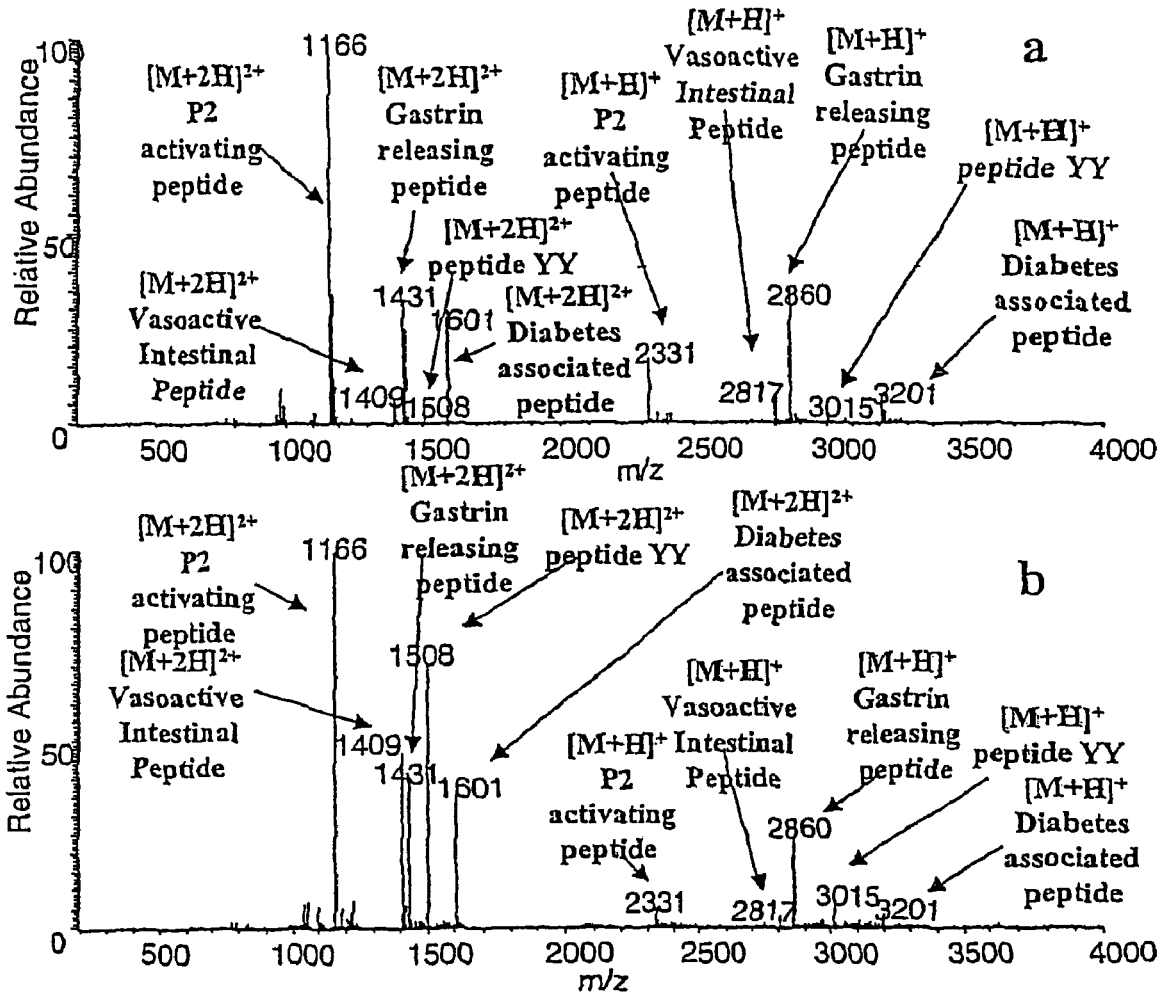

Figure 7: a) Mass spectrum, obtained by direct infusion in the mass spectrometer using *the GPSCI technique and in absence of salts, of a sample containing a mixture of five* peptides as in Figure 2a. The counts/s value was 106 and the S/N ratio of the most abundant peak was 500. b) Mass spectrum obtained by direct infusion in the mass spectrometer using the GPSCI technique, of a sample containing a mixture of five peptides as in (a), but containing 50 mmol/L NH4HCO3.

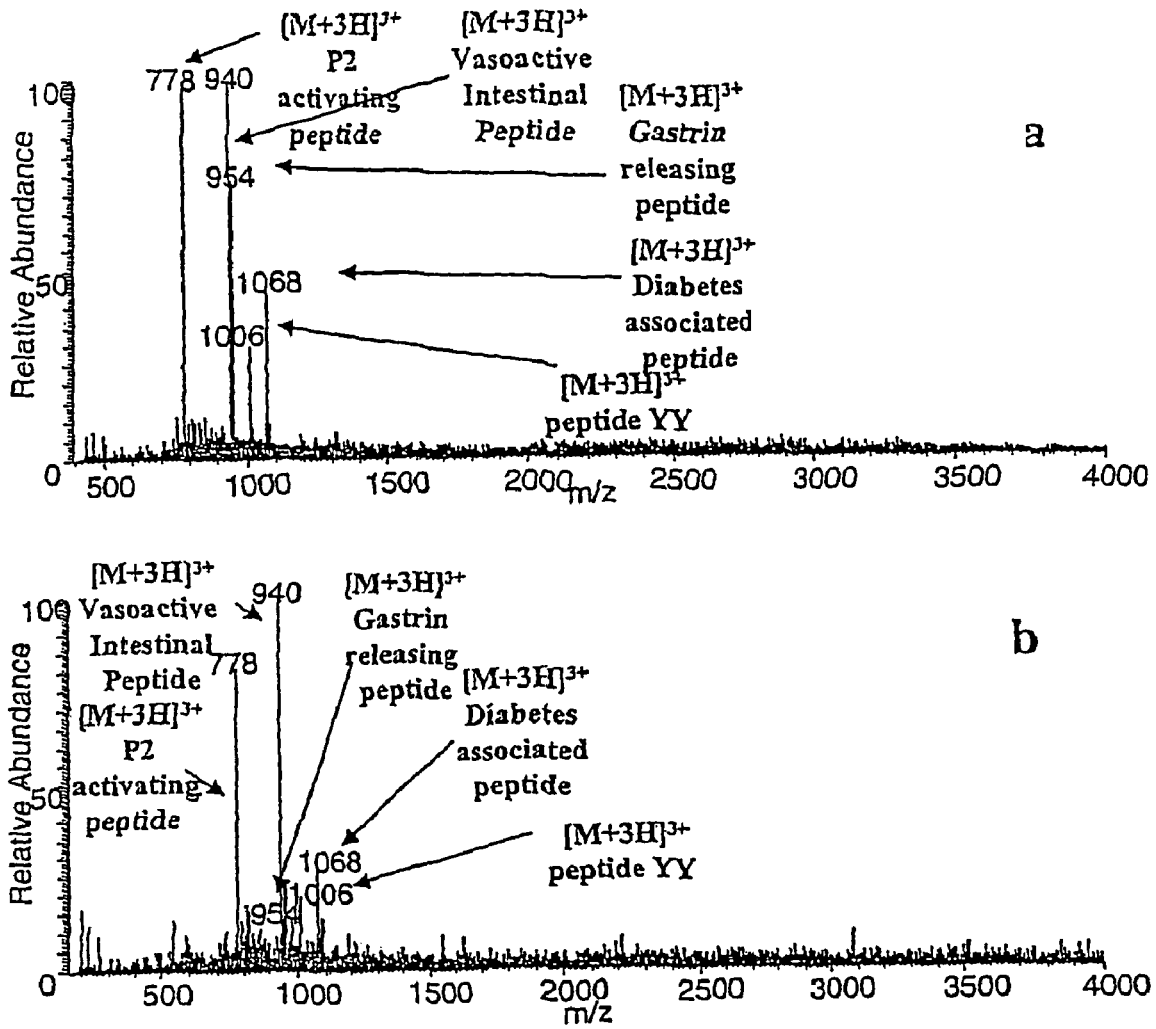

Figure 8: a) Mass spectrum, obtained by direct infusion in the mass spectrometer using the ESI technique, of a sample containing a mixture of five peptides as in figure 2b. The counts/s value was 105 and the S/N ratio of the most abundant peak was 100. b) Mass spectrum, obtained by direct infusion in the mass spectrometer using the ESI technique, of the same sample as in (a) but in the presence of 50 mmol/L NH4HCO3. The counts/s value was 105 and the S/N ratio of the most abundant peak was 100.

IONIZATION SOURCE FOR MASS SPECTROMETRY ANALYSIS

FIELD OF THE INVENTION

This invention relates to the field of mass spectrometry, and more particularly to improvements in the chemical ionization source to be applied to mass spectrometers.

BACKGROUND OF THE INVENTION

A variety of ionization sources, for the analysis of molecules with medium-high molecular weight (like peptides and proteins) are essential components of modern mass spectrometric instruments. The ionization source transforms neutral molecules into ions which can be analyzed by mass spectrometry.

A mass spectrometer generally has the following components:

(1) a device, usually a Liquid Chromatograph, for the separation or de-salting of the molecules contained in a sample;

(2) an ionization source, contained in a chamber, to produce ions from the analyte;

(3) at least one analyzer or filter which separates the ions according to their mass-to-charge ratio;

(4) a detector that counts the number of the ions;

(5) a data processing system that calculates and plots a mass spectrum of the analyte.

The mass spectrometry techniques currently used for the analysis of macromolecules and, especially, proteins and peptides are based on the Electrospray Ionization (ESI) (U.S. Pat. No. 5,756,994; Cunsolo V, Foti S, La Rosa C, Saletti R, Canters G W, Verbeet M. Ph. *Rapid Commun. Mass Spectrom.* 2001; 15: 1817; Wall D B, Kachman M T, Gong S S, Parus S J, Long M W, Lubman D M. *Rapid Commun. Mass Spectrom.* 2001; 15: 1649; Fierens C, Stöckl D, Thienpont L M, De Leenheer A P. *Rapid Commun. Mass Spectrom.* 2001; 15: 1433; Li W, Hendrickson C L, Emmett M R, Marshall A G. *Anal. Chem.* 1999; 71: 4397; Fierens C, Stöckl D, Thienpont L M, De Leenheer A P. *Rapid Commun. Mass Spectrom.* 2001; 15: 451) and Matrix Assisted Laser Desorption Ionization (MALDI) (U.S. Pat. No. 5,965,884; Cozzolino R, Giorni S, Fisichella S, Garozzo D, La fiandra D, Palermo A. *Rapid Commun. Mass Spectrom.* 2001; 15: 1129; Madonna A J, Basile F, Furlong Ed, Voorhees K J. *Rapid Commun. Mass Spectrom.* 2001; 15: 1068; Basile A, Ferranti P, Pocsfalvi G, Mamone G, Miraglia N, Caira S, Ambrosi L, Soleo L, Cannolo N, Malorni A. *Rapid Commun. Mass Spectrom.* 2001; 15: 527; Galvani M, Hamdan M, Rigetti P G. *Rapid Commun. Mass Spectrom.* 2001; 15: 258; Ogorzalek Loo R R, Cavalcali J D, VanBogelen R A, Mitchell C, Loo J A, Moldover B, Andrews P C. *Anal. Chem.* 2001; 73: 4063).

Both techniques are highly effective for the production of ions of biomolecules in the gas phase, to be subsequently analyzed by Mass Spectrometry (MS).

In the case of ESI, multicharge ions of medium/high molecular weight compounds are produced. The mass of macromolecule compounds is then obtained using specific software algorithms.

Mass spectrometry represents an essential technology in the analytical field. It is usually coupled with other separative techniques, so as to identify chemical compounds and quantify complex biological mixtures. Proteins, for instance, are first separated, collected and then digested with Trypsin. The masses of the resulting peptides are determined by mass spectrometry (normal scan MS or tandem mass spectrometry MS/MS). In the case of the MS/MS approach, peptide ions of a single m/z ratio are fragmented by collision induced dissociation (CID) and then analyzed using various mass analyzers (triple quadrupole, ion trap, Fourier transform-ion cyclotron resonance). Each peptide gives origin to specific mass patterns for a given amino acid sequence. The peptide sequences can be obtained by computer analysis of the data using a dedicated software (database search and de novo sequence software). In order to obtain good MS/MS spectra doubly charge peptide ions are preferably fragmented (Cramer R, Corless S. *Rapid Commun. Mass Spectrom.* 2001; 15: 2058). The electrospray and MALDI techniques when are applied to the analysis of peptides with high molecular weight (2000-4000 Thompson (Th)) using the MS/MS approach have some limitations. For instance, when proteins or peptides with high molecular weight are analyzed, ESI multicharge ions are produced. These ions give rise to complex fragmentation spectra, difficult to interpret. For this reason only peptides with a maximum of 15 amino acidic residues can be analyzed by tandem mass spectrometry. In the case of MALDI only mono-charge ions are usually obtained. If the MALDI source is coupled with Time of Flight Mass Analyzer (TOF) the technique used to fragment the ions is the post source decay (PSD). This fragmentation technique give rise to some additional problems; in order to obtain good fragmentation spectra it is usually necessary to use peptide derivatization. A MALDI atmospheric pressure source has recently been coupled with an ion trap analyzer. This configuration makes possible the structural analysis of peptides by MS/MS and $MS^3$. However, it must be emphasized that the MALDI source produces, mainly, mono-charge peptide ions that produce fragmentation spectra more complex and less specific than those obtained by fragmentation of the bi-charge ions.

Another problem that affect both MALDI and ESI techniques is represented by the decrease in sensitivity when salts are present in the sample. In the case of ESI the problem may be solved by coupling the mass spectrometer with a pre-analytical separation step, such as by the use of an High Performance Liquid Chromatographer (HPLC) or other de-salting techniques. This obviously introduces another step in the whole procedure of analysis. The HPLC technique on the other hand cannot be used for the case of MALDI because in this case it is necessary to co-crystallize the analyte with a matrix molecule. Salts contained in the sample must, however, be eliminated before of the crystallization step by well known additional treatments of the sample.

PURPOSE AND DESCRIPTION OF THIS INVENTION AND IMPROVEMENTS OVER THE PRIOR ART

The present invention is based on the introduction of a device for the ionization of neutral molecules in the gas phase. The device comprises an active surface carrying element that, according to this invention, is inserted in the ionization chamber. This technique has been named by us "Surface Activated Chemical Ionization" (SACI). SACI technique allows the ionization to be performed at atmospheric pressure.

Use of an atmospheric-pressure ionization has already been proposed and is known as the APCI technique. APCI instrument makes use of a needle-shaped corona discharge electrode inserted inside the ionization chamber. However, the high energy of the corona discharge electrode leads to the macromolecules fragmentation. The main problem of this method is the lower sensitivity with respect to ESI and MALDI techniques.

We have now surprisingly found that introducing into the ionization chamber a plate-like active-surface carrying element can bring to unexpected results in term of high sensitivity and possibility to detect molecules having a molecular weight in a broad range of values.

According to the invention, the solution containing the analyte is injected in the SACI source through an inlet aperture. The sample is nebulized by a gas flow and vaporized by heating. The ionization chamber contains an active surface carrying element onto which the vaporized molecules of the analyte bump, so that the analyte becomes ionized. This active surface can be made of various materials (steel, glass, quartz etc), both electrically conductive or not. Different molecules can also be bound or absorbed over the surface to improve the ionization process ($H_2$, $D_2O$ and various acid and basic molecules). The analyte neutral molecules which are present in gas phase are ionized by various physical-chemical interactions which take place on the surface. Surface properties and function in catalyzing various kind of reactions is well known (U.S. Pat. No. 5,503,804; U.S. Pat. No. 5,525,308; U.S. Pat. No. 5,856,263; U.S. Pat. No. 5,980,843).

An interesting use of a surface in mass spectrometry is the Surface Enhanced Laser Desorption Ionization (SELDI) (U.S. Pat. No. 6,020,208; U.S. Pat. No. 6,124,137; U.S. Patent No. 20020060290; U.S. Pat. No. 5,719,060). In this case the probe of MALDI mass spectrometer carries an immobilized affinity reagent which binds the analyte on its surface. Furthermore an energy absorbing material is added to the dried sample and Laser Desorption Ionization mass spectrometry is used to analyze the sample. This technique however differs from the SACI because of the fact that the sample can be prepared in advance by deposition over the surface, so that this analysis is quite time consuming. Some ionization source make use of an electrical potential applied to a needle to ionize the sample, in gas phase, by using the corona discharge effect (U.S. Pat. No. 6,407,382; U.S. Pat. No. 5,684,300; U.S. Pat. No. 6,294,779; U.S. Pat. No. 5,750,988; U.S. Pat. No. 6,225,623; U.S. Pat. No. 5,756,994; U.S. Pat. No. 20020074491; U.S. Pat. No. 20020048818; U.S. Pat. No. 20020011560; U.S. Pat. No. 4,849,628).

The use of the SACI ionization source which is disclosed in this invention, represents a key improvement for the production of ions with high molecular weight and low charge (bi-charge ions are usually much abundant). The innovative aspect of this invention over the previous known art can be so summarized:

a) Analytes with higher molecular mass can be studied since the technique is able to generate ions with high molecular weight and low charge, an essential feature useful for obtaining the mass of macromolecule compounds. Best results can be obtained if the source is coupled with a mass analyzer with high mass range like Fourier Transform—Ion Cyclotron Resonance (FT-ICR) or Time Of Flight (TOF).

b) A higher sensitivity can be obtained in the analysis of molecules with high mass and low charge (typically bi-charge ions). This is particularly useful for analyzing biological compounds, like proteins and peptides, which are frequently present at low concentration in biological samples (tissues, urine, etc).

c) The new technique makes it now possible to analyze molecules with medium/high mass and low charge (typically the bi-charge ions), by the MS/MS approach. This feature is useful to characterize proteins and high molecular weight peptides. In fact we have shown that peptides containing more than 15 amino acidic residues can be studied. This is particularly useful for the characterization of peptides with high mass, originated by missed cleavage during the enzymatic digestion reaction.

d) The SACI ionization source is much less affected by the presence of salts than the ESI and MALDI sources. The new invention makes it now possible to analyze liquid biological samples, which usually contain salts or buffers, by direct infusion into the mass spectrometer without using an HPLC systems or other desalting procedures. This is particularly useful for analyzing samples in high throughput applications. Samples containing a high concentration of salts are well known to give rise to serious problem when the ESI or MALDI techniques are used.

Table 1 summarize the critical improvements obtained by the application of SACI vs ESI technique.

TABLE 1

A summary of the critical improvements obtained by the application of SACI vs ESI techniques

| SACI vs ESI | |
|---|---|
| Detect ions with high mass and low charge | Detect multicharge ions with high mass |
| High throughput | Pre-analytical steps limit throughput |
| "Tolerant" of salts | Less tolerant of salts |
| Can sequence peptides with high molecular weight (more than 15 amino acid) | Can not sequence peptides longer than 15 amino acid |
| High sensitivity, | Higher chemical noise |
| Low chemical noise | Lower sensitivity |

BRIEF DESCRIPTION OF THE DRAWINGS

FIG. 2:

Figure 1:
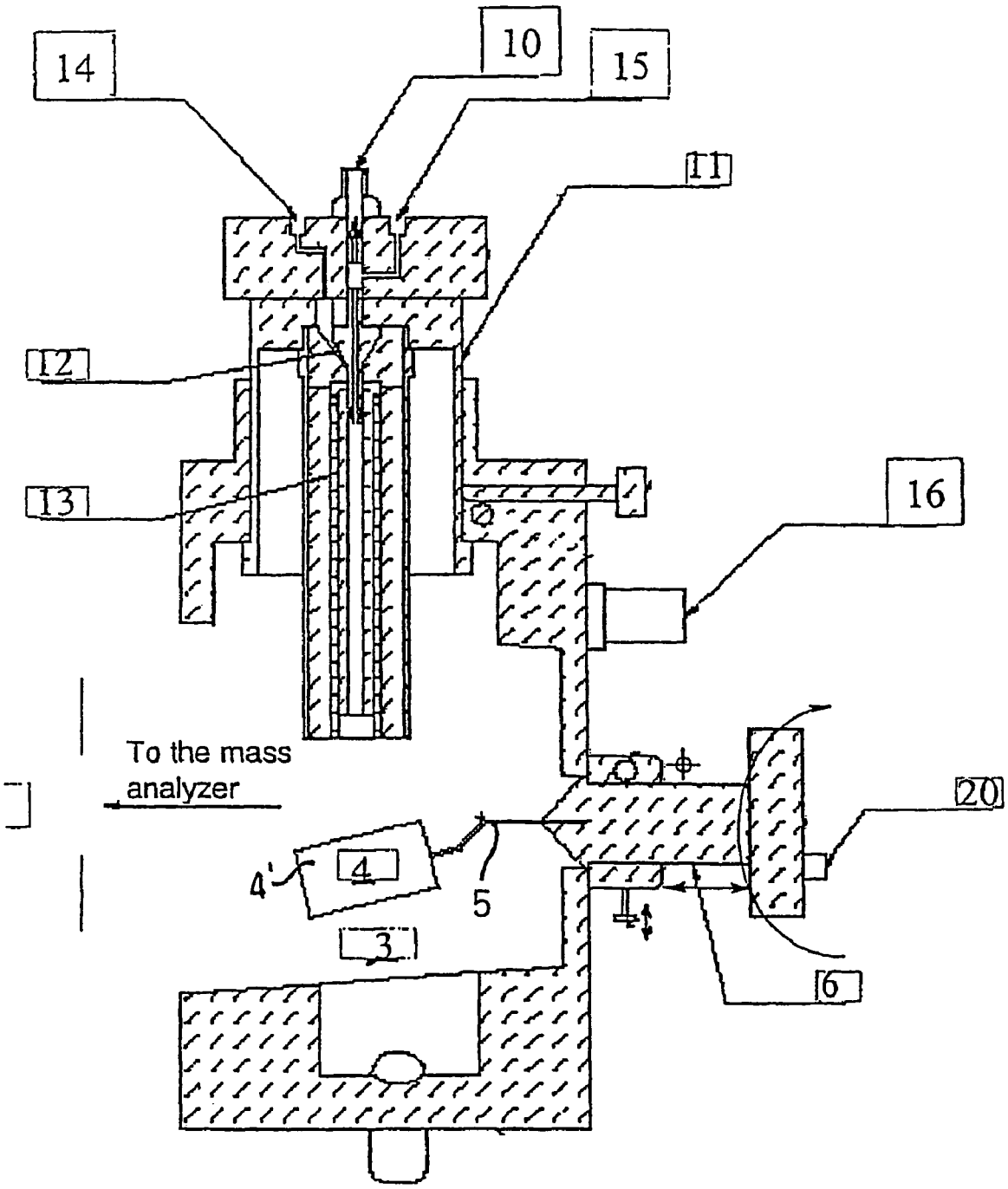
FIG. 1: A schematic representation of the new device, i.e. the Surface Activated Chemical Ionization source (SACI).

a) Mass spectrum, obtained by direct infusion in the mass spectrometer using the SACI technique, of a sample containing a mixture of five peptides (peptide YY fragments 13-36 obtained from Sigma catalog number P6613, MW 3014 Da; Diabetes associated peptide fragment 8-37 obtained from Sigma catalog number. D6170, MW 3200 Da; Gastrin releasing peptide human obtained from Sigma catalog number G8022, MW 2859 Da; Phospholipase 2 activating peptide obtained from Sigma catalog number G1153, MW 2330 Da; and Vasoactive Intestinal Peptide Fragment 6-28 obtained from Sigma catalog number V4508, Mw 2816 Da) acquired in the 400-4000 Th range. The solution concentration of each peptide was $10^{-7}$ M. The counts/s value was $10^6$ and the S/N ratio of the most abundant peak was 500. No salts were added in the pure $H_2O$ solution containing the peptides.

b) Mass spectrum, obtained by direct infusion in the mass spectrometer using the ESI technique, of the same solution as in (a). The counts/s value was $10^5$ and the S/N ratio of the most abundant peak was 100. A much higher chemical noise can be observed in this case, leading to a decrease of the S/N ratio. Using the SACI ionization source the mono and bi-charge ions were mainly obtained, whereas using the ESI ionization source only the tri-charge ions can be detected. It must be emphasized that the multicharge phenomenon, which takes place by using the ESI source, leads to a compression of the mass signals. An overlap of the multicharge signals, which usually takes place for molecules with high molecular weight is also observed.

FIG. 3:

a) Mass spectrum, obtained by direct infusion in the mass spectrometer using the SACI technique, of a standard protein (Cytochrome C) acquired in the 4000-14000 Th range. The protein was obtained by Sigma-Aldrich (catalog number 10,520-1) and diluted in $H_2O$ so to obtain a concentration of $10^{-7}$ M. The counts/s value was $10^6$ and the S/N ratio of the most abundant peak was 300.

b) Mass spectrum obtained by direct infusion in the mass spectrometer using the ESI technique, of the same solution as in (a). No signals were detected in this case. This is due to the extensive multicharge phenomenon that takes place in the ESI ionization source.

c) Multicharge distribution of the Cytochrome C protein obtained using the ESI ionization source. The multicharge distribution is usually compressed in the first region of the spectrum (100-2000 Th) thus leading to a decrease of the sensitivity.

FIG. 4:

a) Tandem mass spectrum, obtained by using the SACI technique, of the bi-charge ion of Vasoactive Intestinal Peptide Fragment 6-28 at m/z 1409.

b) Tandem mass spectrum of the same solution, obtained using the ESI technique. The tri-charge ion at m/z 940 was fragmented. In the case of the fragmentation of the tri-charge ion few fragmentation peaks were obtained.

FIG. 5:

a) Mass spectrum, obtained by direct infusion in the mass spectrometer using the SACI technique, of a sample containing a mixture of five peptides, as in FIG. 2*a*, acquired in the 400-4000 Th range. The solution had a ammonium bicarbonate ($NH_4HCO_3$) concentration of 50 mmol/L. The counts/s value was $10^6$ and the S/N ratio of the most abundant peak was 500.

b) Mass spectrum obtained by direct infusion in the mass spectrometer using the ESI technique, of the same solution as in (a). The counts/s value was $10^5$ and the S/N ratio of the most abundant peak was 100. In the case of the ESI technique a high chemical noise leads to decrease the quality of the spectrum. The multicharge phenomenon also takes place leading to decrease the quality of the spectrum.

FIG. 6:

a) Mass spectrum, obtained by direct infusion in the mass spectrometer using the SACI technique, of a peptide mixture obtained by tryptic enzymatic digestion of Cytochrome C, in the presence of 50 mmol/L $NH_4HCO_3$. The identified peptides are marked by their amino acidic intervals as compared with the original protein sequence. The initial (before tryptic digestion) concentration of the protein was $10^{-7}$ M. The counts/s value was $10^6$ and the S/N ratio of the most abundant peak was 450.

b) Mass spectrum, obtained by direct infusion in the mass spectrometer using the ESI technique, of the same solution. The counts/s value was $10^5$ and the S/N ratio of the most abundant peak was 100. In this case a higher chemical noise as compared with (a) is present. Moreover, in the case of the ESI ionization source spectrum, less peptide signals were detected.

FIG. 7:

a) Mass spectrum, obtained by direct infusion in the mass spectrometer using the SACI technique and in absence of salts, of a sample containing a mixture of five peptides as in FIG. 2*a*. The counts/s value was $10^6$ and the S/N ratio of the most abundant peak was 500.

b) Mass spectrum obtained by direct infusion in the mass spectrometer using the SACI technique, of a sample containing a mixture of five peptides as in (a), but containing 50 mmol/L $NH_4HCO_3$. It must be emphasized that this buffer is commonly used for biological application (for example to perform the tryptic digestion). The counts/s value was $10^6$ and the S/N ratio of the most abundant peak was 500. It should be noted that the presence of the buffer does not lead to a decrease in the quality of the spectrum or a higher chemical noise.

FIG. 8:

a) Mass spectrum, obtained by direct infusion in the mass spectrometer using the ESI technique, of a sample containing a mixture of five peptides as in FIG. 2*b*. The counts/s value was $10^5$ and the S/N ratio of the most abundant peak was 100.

b) Mass spectrum, obtained by direct infusion in the mass spectrometer using the ESI technique, of the same sample as in (a) but in the presence of 50 mmol/L $NH_4HCO_3$. The counts/s value was $10^5$ and the S/N ratio of the most abundant peak was 100. It can be seen that the presence of the buffer leads a decrease of the peaks at m/z 778, 954, 1006 and 1068.

DESCRIPTION OF A PREFERRED EMBODIMENT OF THE PRESENT INVENTION AND APPLICATION EXAMPLES

The SACI source described in this invention and schematically represented in FIG. 1 produces ions that can be analyzed in a mass spectrometer. The spectrometer comprises the ionization source, the analyzer or filter for separating the ions by their mass-to-charge ratio, a detector for counting the ions and a data processing system. Since the structure of the spectrometer is conventional, it will not be described in more detail, but the ionization source device which is the subject of the present invention. The ionization source of the invention, on its turn, does not substantially differ, in its structure, from the known devices of this kind, so that a schematic representation thereof will be sufficient for the skilled man in this art to understand how it is constructed and works.

The ionization source device of the invention comprises an inlet assembly 11 which is in fluid communication with an ionization chamber 3.

The ionization chamber 3 comprises an outlet orifice, generally less than 1 mm in diameter, for communicating between the ionization chamber and the analyzer or filter. Generally, the angle between the axis of the inlet assembly 11 and the axis passing through said orifice is about 90°, but different relative positions can also be envisaged. Inside the ionization chamber 3 is positioned a plate 4. The plate 4 has at least one active surface 4' which faces the internal aperture of the inlet assembly 11. Preferably, the plate 4 is inclined of an angle which allows the analyte to be reflected, once ionized, towards the outlet orifice bringing to the analyzer or filter, so that the highest number of ions can reach the analyzer (mirror effect). This will strongly improve the sensitivity of the method. The said inclination angle will depend of course on the relative position of the axes of both inlet assembly 11 and outlet orifice. For example, if such axes form an angle of 90°, the element 4 will be 45° inclined.

The plate 4 can have different geometries and shapes, such as squared, rectangular, hexagonal shape and so on, without departing for this from the scope of the present invention. It has been found that the sensitivity of the analysis increases when the active surface 4' is increased. For this reason, the plate 4 surface will range preferably between 1 and 4 $cm^2$ and will be generally dictated, as the highest threshold, by the actual dimensions of the ionization chamber 3. While maintaining the dimension of the plate 4 fixed, the active surface 4' area can be increased in various ways, for example by creating corrugations on the surface 4'. In particular cases, such as the case wherein low molecular weight molecules must be analyzed, high electrical field amplitude is required. In such cases, it may be advantageous to provide the active surface 4' with a plurality of point-shaped corrugations, in order to increase in such points the electrical field amplitude.

The plate 4 gas generally a thickness of between 0.05 and 1 mm, preferably of between 0.1 and 0.5 mm.

The active surface 4' can be made of various materials, either of electrically conductive or non-conductive nature. Preferred materials can be a metal such as iron, steel, copper, gold or platinum, a silica or silicate material such as glass or quartz, a polymeric material such as PTFE (Teflon), and so on. When the active surface 4' is comprised of a non-conductive material, the body of the plate 4 will be made of an electrically conductive material such as a metal, while at least a face thereof will be coated with the non-conductive material in form of a layer or film to create the active surface 4'. For example, a stainless steel plate 4 can be coated with a film of PTFE. It is in fact important that, even if of non-conductive nature, the active surface 4' be subjected to a charge polarization. This will be achieved by applying an electric potential difference to the body plate, thus causing a polarization to be created by induction on the active surface 41 too. On the other: hand, if the surface 4' is of electrical conductive nature, the plate 4 does not need to be coated. In this case, a good performance of the ionization source of the invention can be achieved even without applying a potential difference, i.e. by maintaining the surface 4' at ground potential and allowing it to float.

The plate 4 is linked, through connecting means 5, to a handling means 6 that allows the movement of the plate 4 in all directions. The handling means 6 can be moved into the ionization chamber and also can be rotated. The connecting means 5 can be made of different electrically conductive materials and can take various geometries, shapes and dimensions. Preferably, it will be shaped and sized so as to facilitate the orientation of the plate 4 in an inclined position. In this case, the connecting means 5 will have a step-like shape (as shown in FIG. 1). The plate 4 is electrically connected to power supply means 20 in order to apply a potential difference to the active surface 4'.

Coming now to the description of the inlet assembly 11, the liquid sample containing the analyte is introduced into the chamber through the sample inlet hole 10. The inlet assembly 11 comprises an internal duct, open outwardly via the said inlet hole 10, which brings to a nebulization region 12. The said nebulization region is in fluid communication with at least one, typically two gas lines 14, 15 (typically, the gas is nitrogen) which intercepts the main flow of the sample with different angles, so that to perform the functions of both nebulizing the analyte solution (angle >45°) and carrying it towards the ionization chamber 3 (angle <45°). Downstream to the said nebulization region. 12, a heating region 13 is provided. The heating region 13 comprises heating means, such as a heating element connected to a power supply connector 16. The vaporized analyte is thus heated at temperatures ranging from 200° C. and 450° C., preferably of between 250° C. and 350° C. The internal duct of the inlet assembly 11 ends into the ionization chamber 3 in a position which allows the vaporized and heated analyte to impact the active surface 4' of the plate 4, where the ionization of the neutral molecules of the analyte takes place. Without being bound to any particular theory, it is likely that a number of chemical reactions take place on the surface: proton transfer reactions, reaction with thermal electron, reaction with reactive molecules located on the surface, gas phase ion molecule reactions, molecules excitation by electrostatic induction. It is also possible that the dipolar solvent is attracted from the active surface 4' by means of the charge polarization induced on it and so provide a source of protons that react with the analyte molecules to form ions. As said before, the plate 4 can be allowed to float—only if the active surface 4' is electrically conductive, since in this case an electron exchange flow can be established between the solvent and the surface 4'—or a potential difference can be applied. Such a potential difference, as absolute value, will preferably be in the range of from 0 and 1000 V (in practice, can range between −1000 V and +1000 V, depending on the kind of polarization that is required on the active surface 4'), preferably of from 0 and 500 V, more preferably of from 0 and 200 V. High voltage, such as about 200 V, allows the ionization yield to be increased. The possibility given by the present invention device to work both with and without a voltage to be applied to the analyte is of pivotal importance. In fact, in some instances, there are molecules that do not suffer a strong electrical field, such as the macromolecules or even some small molecules like amphetamines, which degrade in such strong conditions. In general, it can be said that the absence of a voltage applied to the plate 4 avoids redox reactions to the analyte.

For the reasons seen above, it is important that the solvent in which the analyte is dissolved be a dipolar solvent having acidic protons. Preferred solvents are $H_2O$, alcohols such methanol or ethanol, acetonitrile.

The impact angle of the analyte onto the active surface 4' will be preferably 45° or less. Low impact angle values allow a better contact between the analyte and the active surface, thus improving the ionization performance.

In a preferred embodiment of the invention, the analyte solution also contains aminoacids such as glycine, lysine, istidine, aspartic acid and glutammic acid, which have the function of proton donors to promote the analyte ionization.

The ions so formed are reflected and directed to the analyzer 1 through the outlet orifice, as described above.

The essential feature of the invention consists in the introduction of a n active surface 4' in the vaporization chamber 3, that enhances the ionization of the neutral analyte molecules present in gas phase. The SACI can be considered a soft ionization source, which can be of particular interest in several applications, such as in the field of drugs and anti-doping analysis.

It should be understood that the above description is intended to illustrate the principles of this invention and is not intended to limit any further modifications, which can be made following the disclosure of this patent application by people expert in the art.

The following, not limiting, examples are described to illustrate the novelty and usefulness of the invention.

EXAMPLE 1

The Observation of Ions in the High Mass Range

A $10^{-7}$ M solution of Cytochrome C protein (MW: 12361) has been analyzed by direct infusion. FIG. 3*a* shows the protein signals obtained using the new SACI ionization source. The mono-charge, bi-charge and tri-charge ions were clearly detected using positive acquisition mode. This compares with results on the same solution achieved by the use of the ESI ionization source (FIG. 3*b*). In this latter case no multicharge distribution was detected in the 4000-14000 Th range. In fact signals obtained in this region of the spectrum by the use of the ESI ionization source are due to the chemical noise of the solvent. It is well known that the ESI ionization source cannot be used to analyze molecules with high molecular weight and low charge. Thus the ESI technique has serious limits for analyzing biological molecules with high molecular weight (like proteins). In order to overcome this limitation the MALDI ionization source is used since. The ionization source of MALDI is able to produce low charge ions in the range 1000-300000 Th. The application of MALDI technique, however, requires co-crystallization of the analyte with a matrix molecule. To ionize the sample a laser light that is mainly adsorbed by the matrix molecule is ordinary used. A micro explosion process (ablation) take place on the surface of the crystal and the excited matrix molecules ionize the sample molecules in gas phase (soft ionization reaction). For this reason a HPLC or similar on line separation methods cannot be used in the MALDI approach. It must be emphasized that the SACI ionization source is able, like the MALDI source, to generate ions with high molecular weight and low charge, but, in addition, it can be coupled in line with HPLC or other separatory methods.

EXAMPLE 2

An Application of SACI Technique to the Analysis of High Molecular Weight Peptides Five high molecular weight standard peptides with molecular mass in the 2000-4000 Da range were analyzed. The results obtained using the SACI source are shown in FIG. 2*a*. As can be seen the mono and bi-charge peptide ions were clearly detected. The peptides were analyzed also by a mass spectrometer using the ESI ionization source (FIG. 2*b*). In this case the tri-charge peptide ions are the most abundant species. These species are located in a region of the spectrum (500-1100 Th) in which the chemical noise is high leading to decrease the S/N ratio.

The mass analyzer used to perform both experiments was an ion trap ($LCQ^{XP}$, ThermoFinnigan, USA) able to detect the signals in the 100-4000 Th and 1000-20000 Th range. The mass acquisition range can also be extended by coupling the SACI ion source with other kind of mass analyzer (for example TOF or FT-ICR) provided with a high mass acquisition range.

EXAMPLE 3

Increase in Sensitivity Provided by the New Ionization Source

The SACI ionization source first described in the present invention is characterized by a higher sensitivity, as compared to the ESI technique, in the analysis of liquid samples of proteins and peptides. FIGS. 2*a* and 3*a* show the spectra obtained by direct infusion of solutions of five high molecular weight peptides (FIG. 2*a*) and Cytochrome C (FIG. 3*a*). A $LCQ^{XP}$ (ThermoFinnigan, USA) provided with SACI ionization source was used. The solution concentration of each standard peptide and of the Cytochrome C was $10^{-7}$ M and the counts/s value was $10^6$ with a S/N ratio of the most abundant peak of 500 for the high molecular weight peptides and 300 for the Cytochrome C protein. The comparison of these results with those obtained, for the same solutions, using the ESI ionization source (FIGS. 2*b* and 3*b*) shows that the SACI ionization source increases the sensitivity. As can be seen for the case of the ESI spectra of the same high molecular weight peptides (FIG. 2*b*) the most abundant signals (tri-charge ions) are detected in the 500-1100 Th range, due to the multicharge phenomenon. Furthermore, the chemical noise is higher (S/N ratio of the most abundant peak=100) using the ESI technique than that obtained by the SACI ionization source (S/N ratio of the most abundant peak=500).

In the spectrum of the Cytochrome C, obtained by the ESI ionization source. (FIG. 3*b*), no protein signal has been detected in the 4000-14000 Th range. This is due to the extensive multicharge phenomenon that takes place in the ESI ionization source. For this reason the multicharge distribution is usually compressed in the 100-2000 Th range (FIG. 3*c*) where the chemical noise is higher.

EXAMPLE 4

Characterization of High Molecular Weight Peptides

The tandem mass spectrometry (MS/MS) of bi-charge ions, that are abundantly produced by the SACI source, can be further characterized. In FIG. 4*a* the SACI-MS/MS spectrum of the bi-charge ion of Vasoactive Intestinal Peptide Fragment 6-28 is shown. The bi-charge ion was isolated into the ion trap analyzer and fragmented by Collision Induced Dissociation (CID). The results of the peptide identification and its relative statistical correlation score, by the use of the SEQUEST database search program, were as follows:

| Peptide | Xcorr | DeltCn |
|---|---|---|
| Vasoactive Intestinal Peptide Fragment 6-28 | 3.5382 | 0.204 |

Xcorr is a spectra correlation score and DeltCn is the 1.0—normalized correlation score. A correctly identified peptide has a value of Xcorr score higher than 3. The peptide was also analyzed using the ESI ionization source (FIG. 4*b*). In this case the bi-charge peak at m/z 1409 had a too weak intensity to obtain an MS/MS spectrum. Thus, the tri-charge ion at m/z 940 was fragmented. The statistical correlation score and the DeltCn in this case were as follows:

| Peptide | Xcorr | DeltCn |
|---|---|---|
| Vasoactive Intestinal Peptide Fragment 6-28 | 1.2280 | 0.608 |

As can be seen by the Xcorr and DeltCn scores so calculated, the peptide characterization is statistically more accurate using the SACI-MS/MS spectrum obtained fragmenting the bi-charge ions at m/z 1409.

EXAMPLE 5

Effect of Salts on Sensitivity

FIGS. 5*a* and 6*a* show the mass spectra of a solution of five standard peptides and of peptides obtained by Cytochrome C tryptic digestion all in 50 mmol/L $NH_4HCO_3$ buffer. The SACI ionization source was used. In both cases the solution concentration was $10^{-7}$ M. The counts/s value was $10^6$ and the S/N ratio was 500 in the case of the high molecular weight peptides and 450 in the case of Cytochrome C peptides. The results obtained using the ESI ionization source is shown in FIGS. 5*b* and 6*b*. As can be seen in these latter cases the mass spectra show a high chemical noise, due to the presence of the buffer. This leads to a decrease in sensitivity as compared to that obtained by the use of SACI ionization source. In fact the counts/s value was an order of magnitude lower ($10^5$) and the S/N ratio of the most abundant peak (100) is 5 times lower.

In order to show that the S/N ratio is not affected by salts, FIG. 7 reports the mass spectra of five high molecular weight peptides acquired without (FIG. 7*a*) and with (FIG. 7*b*) salts in the sample solutions. The SACI ionization source was used in both cases. As can be seen salts do not lead to a decrease of the spectrum quality. This fact is very important when biological mixtures are analyzed. In fact these mixtures almost always contain salts or buffers (as for example $NH_4HCO_3$ used for the tryptic digestion) that give rise to well known effect on the ESI mass spectra.

FIG. 8 shows the spectra obtained by analyzing the high molecular weight peptide solutions in absence (FIG. 8*a*) and in presence. (FIG. 8*b*) of salts by the standard ESI technique. In both cases the spectra show a higher chemical noise than in those obtained using the SACI ionization source (respectively shown in FIGS. 7*a* and 7*b*). The addition of the $NH_4HCO_3$ buffer to the solution analyzed by the ESI technique decrease the peptide signals at m/z 1068, 1006, 778 and 954. For this very reason an HPLC or other separation steps system is coupled with the ESI ionization source. A chromatographic analysis, however, takes time and increases the number of manipulation of the sample before analysis. This is a limit especially when many samples must be analyzed.

The invention claimed is:

1. Atmospheric-pressure ionization source device, adapted for atmospheric-pressure ionizing analytes in liquid phase, to be further analyzed by mass spectrometry, comprising (a) an inlet assembly, in which the analytes in liquid phase are injected, nebulized and vaporized by heating; and (b) an atmospheric-pressure ionization chamber with which said inlet assembly is in fluid communication, said ionization chamber being provided with an outlet orifice for communicating between said ionization chamber and an analyzer or filter of a mass spectrometer, wherein said atmospheric-pressure ionization chamber comprises a plate having at least one active surface which faces internal apertures of said inlet assembly and onto which the vaporized molecules of the analytes bump and are ionized, said active surface being charge polarized wherein said plate is inclined at an angle which allows the ionized analyte to be reflected towards the analyzer of the mass spectrometer.

2. The atmospheric-pressure ionization source device of claim 1, wherein the said active surface is charge polarized by connection with power supply means.

3. The atmospheric-pressure ionization source device of claim 1, wherein the said active surface is charge polarized by induction.

4. The atmospheric-pressure ionization source device according to claim 1, wherein the said plate and the said at least one active surface are made of an electrically conductive material.

5. The atmospheric-pressure ionization source device according to claim 4, wherein the said electrically conductive material is chosen between iron, steel, gold, copper or platinum.

6. The atmospheric-pressure ionization source device according to claim 4, wherein the said plate is coated with a non-conductive material to form the said at least one active surface.

7. The atmospheric-pressure ionization source device according to claim 6, wherein the said non-conductive material is chosen between a silica or silicate derivative such as glass or quartz or a polymeric material such as PTFE.

8. The atmospheric-pressure ionization source device according to claim 1, wherein the said at least one active surface is provided with corrugations.

9. The atmospheric-pressure ionization source device according to claim 8, wherein said corrugations are point-shaped corrugations.

10. The atmospheric-pressure ionization source device according to claim 1, therein said angle is 45° when the angle between the axes of both the inlet assembly and the outlet orifice is 90°.

11. The atmospheric-pressure ionization source device according to claim 1, wherein the plate is 0.05 to 1 mm thick, preferably 0.1 to 0.5 mm thick.

12. The atmospheric-pressure ionization source device according to claim 1, wherein the said plate is linked, through connecting means, to a handling means that allows the movement of the said plate in all directions.

13. The atmospheric-pressure ionization source device according to claim 12, wherein the said connecting means are made of an electrically conductive material.

14. The atmospheric-pressure ionization source device according to claim 12, wherein the said connecting means are step-like shaped.

15. The atmospheric-pressure ionization source device according to claim 1, wherein the said plate is connected to power supply means.

16. The atmospheric-pressure ionization source device according to claim 1, wherein the said inlet assembly comprises an inlet hole for feeding the analyte solution and an internal duct in fluid communication with the said inlet hole, said internal duct comprising a nebulization region and a heating region and ending into the said atmospheric-pressure ionization chamber.

17. The atmospheric-pressure ionization source device according to claim 16, wherein the said nebulization region is in fluid communication with at least one gas lines for nebulizing the analyte solution and carrying it towards the atmospheric-pressure ionization chamber.

18. The atmospheric-pressure ionization source device according to claim 17, wherein the said gas is nitrogen.

19. The atmospheric-pressure ionization source device according to claim 1, wherein the said heating region comprises heating means, preferably a heating element connected to a power supply connector.

20. A mass spectrometer comprising a atmospheric-pressure ionization source device as defined in claim 1.

21. The mass spectrometer according to claim 20, further comprising:

(1) a device, optionally a Liquid Chromatograph, for the separation or de-salting of the molecules contained in a sample;

(2) at least one analyzer or filter which separates the ions according to their mass-to-charge ratio;

(3) a detector that counts the number of the ions;

(4) a data processing system that calculates and plots a mass spectrum of the analyte.

22. A method for atmospheric-pressure ionizing an analyte to be analyzed by mass spectrometry, the method comprising:

(a) dissolving the analyte in a suitable solvent;

(b) injecting the said analyte solution into a atmospheric-pressure ionization source device as described in claim 1;

(c) causing the analyte solution to be vaporized and heated;

(d) causing the vaporized and heated analyte solution to impact onto an active surface;

(e) causing the ionized analyte to be collected by the analyzer or filter of a mass spectrometer.

23. The method according to claim 22, wherein the analyte is dissolved in a dipolar solvent.

24. The method according to claim 23, wherein the solvent is selected from $H_2O$, an alcohol optionally methanol or ethanol, or acetonitrile.

25. The method according to claim 22, wherein the said active surface is inclined of an angle defining an impact angle for the said vaporized and heated analyte solution, wherein the said impact angle onto the active surface is 45° or less.

26. The method according to claim 22, wherein the analyte solution is heated at a temperature in the range of from 200° C. and 450° C., optionally from 250° C. and 350° C.

27. The method according to claim 22, wherein a potential difference of between 0 and 1000 V, in absolute value, is applied to the said active surface.

28. The method according to claim 27, wherein the said potential difference, in absolute value, is of between 0 and 500 V, optionally between 0 and 200 V.

29. The method according to claim 22, wherein the said analyte solution contains further an amino acid, optionally selected from the group consisting of glycine, lysine, istidine, aspartic acid and glutammic acid.

30. The atmospheric-pressure ionization source device of claim 1, wherein said inlet assembly is operative to supply neutral molecules in gas phase to said atmospheric-pressure ionization chamber.

* * * * *